United States Patent [19]

Kunii

[11] 4,377,349

[45] Mar. 22, 1983

[54] BALL POINT PEN

[76] Inventor: Shusaku Kunii, 39-36, Nishishinjuku 4-Chome, Shinjuku-Ku, Tokyo, Japan

[21] Appl. No.: 273,134

[22] Filed: Jun. 12, 1981

[51] Int. Cl.[3] ..... B43K 7/12

[52] U.S. Cl. ..... 401/115; 401/100; 401/104; 401/209; 24/11 R

[58] Field of Search ..... 401/115, 68, 84, 95, 401/100, 209; 24/11 S, 11 HC, 10 R, 11 R

[56] References Cited

U.S. PATENT DOCUMENTS

| | | | |
|---|---|---|---|
| 2,029,767 | 2/1936 | Eisenhauer | 24/11 S |
| 2,644,212 | 7/1953 | Markowitz | 24/11 HC |
| 2,813,511 | 11/1957 | Kersten | 401/100 |
| 2,913,789 | 11/1959 | Loredo | 24/10 R |
| 3,097,406 | 7/1963 | Yarborough | 24/303 |
| 3,507,149 | 4/1970 | Copeland | 24/303 |
| 3,638,280 | 2/1972 | Di Spirito | 24/11 S |
| 4,176,979 | 12/1979 | Saida | 401/115 |

FOREIGN PATENT DOCUMENTS

| | | | |
|---|---|---|---|
| 663362 | 5/1963 | Canada | 401/115 |
| 248027 | 1/1911 | Fed. Rep. of Germany | 401/68 |
| 1157075 | 12/1957 | France | 401/115 |
| 428905 | 5/1935 | United Kingdom | 401/68 |
| 1116300 | 6/1968 | United Kingdom | 401/68 |

*Primary Examiner*—Clyde I. Coughenour

*Attorney, Agent, or Firm*—Flynn, Thiel, Boutell & Tanis

[57] ABSTRACT

A ball point pen has a cartridge which can be projected by orienting the front end of a ball point pen main body downward and which can be retracted by orienting the front end of the main body upward. A weight with a notch or the like is mounted to the cartridge to shift the overall center of gravity of the cartridge and the weight from the axis of the main body. This allows complete engagement of the distal end portion of the cartridge with an engaging step formed inside the main body, so that accidental retraction of the cartridge back into the main body may be prevented during writing.

7 Claims, 3 Drawing Figures

BALL POINT PEN

BACKGROUND OF THE INVENTION (1) Field of the Invention

The present invention relates to a ball point pen and, more particularly, to a ball point pen which is ready to be employed for writing when the front end of the pen is oriented downward to thereby project the tip of a cartridge from a ball point pen main body and which is, on the other hand, capable of automatically accommodating the tip of the cartridge inside the ball point pen main body when the front end of the ball point pen main body is oriented upward.

(2) Description of the Prior Art

A ball point pen is conventionally known in which the tip of a cartridge, which engage an engaging step arranged inside the ball point pen main body when the tip of the cartridge accommodated inside the main body, is projected therefrom, so that retraction of the cartridge into the main body may be prevented and writing may be easily performed. However, with a ball point pen of this type, when the tip of the cartridge is projected from the main body, the tip of the cartridge must engage with the engaging step inside the main body without failure to prevent the retraction of the cartridge into the main body.

During writing, however, the tip of the cartridge is constantly brought into contact with and withdrawn from a sheet of paper, and pressure is exerted on the cartridge from various directions. With a conventional ball point pen, the force of gravity of the cartridge acts along the axial direction. Therefore, especially when the ball point pen is used under the condition that it is almost vertical with respect to the plane of the paper, the cartridge swings in an unstable manner inside the ball point pen main body and the engagement between the tip of the cartridge and the engaging step inside the main body may be easily disturbed when the tip of the cartridge is withdrawn from the sheet of paper. In such a case, when the tip of the cartridge is again pressed against the sheet of paper, the cartridge tends to become retracted into the main body.

BRIEF SUMMARY OF THE INVENTION

The present invention has been made in view of the above and has for its object to provide a ball point pen wherein a weight is slidably fitted with the cartridge in such a manner as to shift the center of gravity of the weight from the axis of the cartridge to thereby shift the overall center of gravity of the cartridge from its axis, so that the cartridge may not be suddenly retracted into the main body during writing. When the center of gravity of the overall structure consisting of the weight and the cartridge is shifted from the axis of the cartridge, the cartridge is always inclined in one direction by the shifting of the cartridge when the ball point pen is oriented vertically. In addition, the condition under which the force of gravity acts on the overall structure exactly along the vertical direction may not be easily attained unless the ball point pen main body is inclined. For these reasons, the ball point pen main body and the cartridge are constantly inclined with respect to each other so that the engagement of the tip of the cartridge with the engaging step of the main body may be maintained and the accidental retraction of the cartridge into the main body during writing may be prevented.

BRIEF DESCRIPTION OF THE DRAWINGS

The nature, principle, and details of the invention will be more clearly apparent from the following detailed description with respect to a preferred embodiment of the invention when taken in conjunction with the accompanying drawings, in which.

DESCRIPTION OF THE PREFERRED EMBODIMENTS

Figure 1:
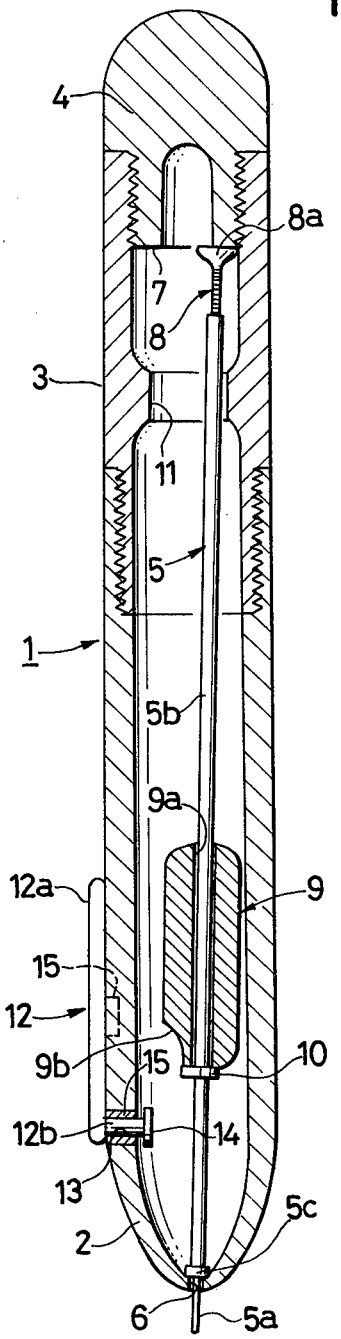
FIG. 1 is a sectional view illustrating an embodiment of the present invention.

A preferred embodiment of the present invention will now be described with reference to the accompanying drawings. Referring to FIG. 1, a ball point pen main body 1 comprises three members of a front end 2, a central body 3 and a distal end 4 and houses a cartridge 5. A through hole 6 for receiving a tip 5*a* of the cartridge 5 is formed at the extreme end of the front end 2. Part of the front end 2 close to the through hole 6 is gradually tapered so that the tip 5*a* of the cartridge 5 housed inside the main body 1 may be smoothly guided by the inner wall of the tapered part to fit with and project from the through hole 6. A cylindrical body 5*b* of the cartridge 5 for holding ink has a diameter greater than the inner diameter of the through hole 6. A step 5*c* between the cylindrical body 5*b* and the tip 5*a* contacts the inner wall of ball point pen main body 1 for preventing the whole cartridge 5 from projecting from the main body 1.

Figure 3:
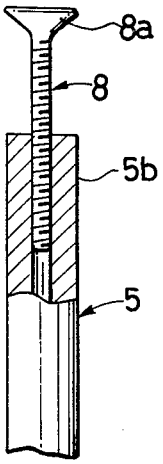
FIG. 3 is an enlarged sectional view of a main part of the embodiment shown in FIG. 1.

The distal end 4 of the ball point pen main body 1 threadably engages with the inside of the central body 3, and the lower end face of the distal end 4 functions as an engaging step 7. A screw 8 threadably engages with the distal end of the cartridge 5, which has, as shown in FIG. 3, a head 8*a* having a flat top surface and a diameter greater than that of the cylindrical body 5*b* so that the total length of the cartridge, that is, the length from the top surface of the head 8*a* of the screw 8 to the undersurface of the step 5*c*, may be adjustable.

A weight 9 is slidably mounted on the cartridge 5 as shown in the figure so that the engagement between the head 8*a* of the screw 8 with the engaging step 7 may be maintained during writing and the cartridge may be retracted into the main body 1 upon a single movement for accommodating the cartridge. This weight 9 is cylindrical in shape and has along its axis a central hole 9*a* into which the cartridge 5 may be slidably fitted. The weight 9 is slidable between the head 8*a* and a ring-shaped stopper 10 disposed at a predetermined position of the cylindrical body 5*b* of the cartridge 5. A notch 9*b* is formed at part of the weight 9 so as to shift the center of gravity from the central hole 9*a*, that is, from the cartridge 5. Therefore, even when the ball point pen is oriented vertically, the cartridge 5 is inclined by the weight 9 so as to assure the engagement of the head 8*a* with the engaging step 7. For the purpose of shifting the center of gravity of the weight 9 from the cartridge 5, other suitable measures may be taken instead of forming the notch 9*b*. For example, it is possible to form an extension at part of the weight 9, to deviate the central hole 9*a* from the axis of the weight 9, or to constitute the weight with a plurality of members having different specific gravity.

The outer diameter of the weight 9 is set to be smaller than the inner diameter of the main body 1 so as to allow inclination of the cartridge 5 inside the main body 1. An extended part 11 is formed on the inner wall of the central body 3 for guiding the weight 9 to coincide with the axis of the main body 1 when the front end of the main body 1 is oriented upward so that the tip of the cartridge 5 may be displaced to the center of the main body 1 to disengage the head 8*a* from the engaging step 7. The front end side of the extended part 11 is smoothly tapered to smoothly guide the weight 9 within the extended part 11. The size of the extended part 11 need only be sufficient to disengage the head 8*a* from the engaging step 7 without failure, but must not be so big that it contacts the cartridge 5, preventing the head 8*a* from engaging with the engaging step 7. This extended part 11 need not be formed over the entire circumferential area of the main body 1, but may be in the form of ribs.

Figure 2:
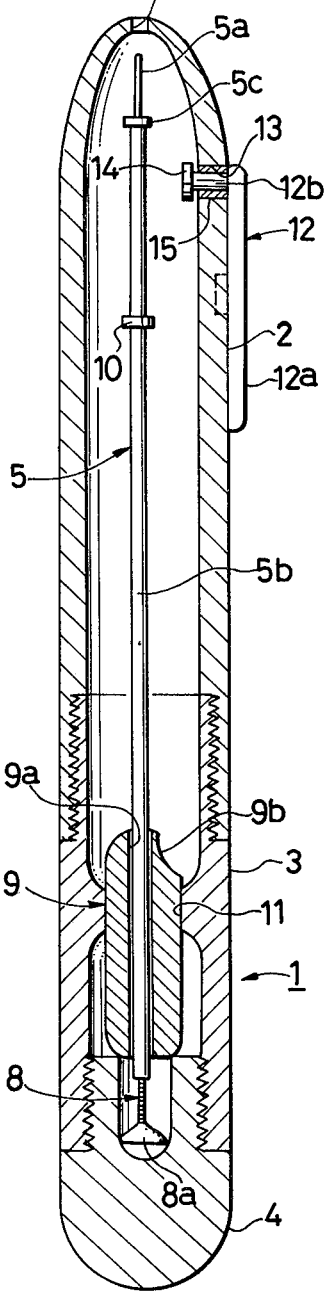
FIG. 2 is a sectional view of the embodiment shown in FIG. 1 under a different condition.

In this embodiment, as shown in FIGS. 1 and 2, a clip 12 mounted at the front end of the ball point pen main body 1 has a plate-shaped main body 12*a* curved along the outer circumference of the main body 1 and a stop 12*b* of pin shape mounted at the distal end of the main body 12*a*. This stop 12*b* is slidably or pivotally inserted inside a hole 13 formed in the main body 1. The withdrawal of the clip 12 from the hole 13 is prevented by a stopper 14. A magnet 15 is disposed inside the hole 13 to securely hold the main body 12*a* to the main body 1 so that the clip 12 may not interfere with writing. Moreover, if a girl puts the ball point pen inside her handbag, the clip 12 will not clamp a handkerchief or tissues. The magnet 15 may be disposed at the position as indicated by dotted lines in FIG. 1.

With the ball point pen of the construction described above, when the front end of the ball point pen main body 1 is oriented downward from the condition under which the cartridge 5 is completely housed inside the ball point pen main body 1, the cartridge 5 moves downward relative to the main body 1 by its own weight and the weight 9. Then, the tip 5*a* projects outward through the through hole 6 while the head 8*a* of the screw 8 engages with the engaging step 7 to allow writing. In this case, even if the ball point pen main body 1 is oriented vertically, the cartridge 5 may be inclined since the center of gravity of the weight 9 is shifted from the cartridge 5 to allow engagement of the head 8*a* of the screw 8 with the engaging step 7. Further, since the head 8*a* has a diameter greater than that of the cylindrical body 5*b*, it is capable of engaging with the engaging step 7 even when only a little inclined and it is also easier to prevent interference between the extended part 11 and the cartridge 5. After the head 8*a* and the engaging step 7 engage with each other, they may not be disengaged even when the inclination of the main body 1 is varied, as long as the front end of the ball point pen main body 1 is oriented downward.

During the manufacture of the ball point pen, the screw 8 is made to threadably engage with the cartridge 5 through standard length. However, when the engagement of the head 8*a* with the engaging step 7 is impossible or insufficient due to manufacturing error or the like in the cartridge 5 or the main body 1, the screw 8 may be rotated to adjust the length of the cartridge 5. Complete engagement may thus be easily obtained.

For retracting the cartridge 5 back into the main body 1, the front end of the pen is simply oriented upward. Then, as shown in FIG. 2, the weight 9 moves downward along the cartridge 5 to fit within the extended part 11 for forcibly moving the head 8*a* of the cartridge 5 to a position at which it may no longer engage with the engaging step 7. Thus, these two parts are disengaged, and the cartridge 5 is retracted inside the main body 1 by its own weight.

It is to be noted that the head 8*a* of the screw 8 need not have a diameter greater than the outer diameter of the cylindrical body 5*b*. In such a case, the weight 9 may be freely dismounted from the cartridge 5 so that the replacement of the cartridge 5 becomes easy.

In the embodiment described above, the extended part 11 is formed on the inner wall of the central body 3 of the main body 1 so as to disengage the head 8*a* from the engaging step 7 by guiding the weight 9 to the axis of the main body 1 when the front end of the main body is oriented upward. However, this extended part 11 is not absolutely necessary. For example, by suitably selecting the clearance between the inner diameter of the main body 1 and the outer diameter of the weight 9 or the clearance between the outer diameter of the head 8*a* and the inner diameter of the recessed part of the terminal end 4 to receive it, the inner wall of the main body 11 may be provided as a guide of the weight 9 to achieve disengagement of the engaging step 7 and the head 8*a*.

Although the present invention has been described in connection with a preferred embodiment thereof, many variations and modifications will now become apparent to those skilled in the art. It is preferred, therefore, that the present invention be limited not by specific disclosure herein, but only by the appended claims.

What is claimed is:

1. A ball point pen comprising: an elongated main body having an elongated central bore therewithin, said central bore having a laterally inwardly extending, engaging step located near to but spaced longitudinally inwardly from one longitudinal end of said central bore, said main body having a through hole of smaller size than said central bore and extending from the opposite longitudinal end of said central bore; an elongated cylindrical ink cartridge having a stopper intermediate its opposite longitudinal ends and having a writing tip extending longitudinally from one longitudinal end of said cartridge and adapted to be extended through said through hole, said cartridge being disposed within said central bore and being movable both laterally and lengthwise in said central bore, said cartridge and said writing tip being movable between a first retracted position in which said cartridge and said writing tip are entirely received within said central bore and are substantially coaxial therewith and a second extended position in which said writing tip projects through said through hole and said cartridge is inclined with respect to the axis of said central bore and the other longitudinal end of said cartridge abuts against said step; and an elongated cylindrical weight having an elongated central hole, the axis of which is coaxial with the axis of said cartridge, said cartridge extending through said central hole with the wall defining said central hole closely surrounding the external wall of said cartridge so that said weight is supported on said cartridge for closely guided sliding movement, by gravity, in a direction lengthwise of and coaxial with said cartridge between a first position in which said weight is located close to said other longitudinal end of said cartridge when said cartridge is in said first retracted position and a second position in which said weight abuts against said stopper when said cartridge is in said second extended position, the center of gravity of said weight being laterally offset from the axis of said central hole in order continuously to maintain said cartridge inclined with respect to the axis of said central bore when said cartridge is in said second extended position.

2. A ball point pen as claimed in claim 1 in which said central hole is coaxial with the central longitudinal axis of said weight and the periphery of said weight has a notch therein so that said weight is non-symmetrical and the center of gravity of said weight is laterally offset from the axis of said central hole.

3. A ball point pen as claimed in claim 1 in which said central hole of said weight is laterally offset from the central longitudinal axis of said weight so that the center of gravity of said weight is laterally offset from the axis of said central hole.

4. A ball point pen as claimed in claim 1 in which said weight is made of a plurality of members having different specific gravities so that the center of gravity of said weight is laterally offset from the axis of said central hole.

5. A ball point pen as claimed in claim 1 in which said central bore has a cylindrical neck portion of reduced diameter located between and spaced longitudinally from said step and the opposite longitudinal end of said central bore and coaxial with the axis of said central bore, said neck portion having substantially the same diameter as the external diameter of said weight so as to slidably receive said weight therewithin and thereby to hold said weight and said cartridge in a position coaxial with the axis of said central bore when said cartridge is in said first retracted position.

6. A ball point pen as claimed in claim 1 in which said cartridge has an axially extending screw adjustably threaded into said opposite longitudinal end thereof and extending outwardly therefrom, said screw having an outer end adapted to engage said step when said cartridge is in said second extended position.

7. A ball point pen as claimed in claim 1 including a clip rockably mounted on the exterior surface of said body near to said opposite longitudinal end thereof and a permanent magnet mounted on said main body adjacent said clip for releasably holding said clip against said main body.

* * * * *